US007442093B2

(12) United States Patent
Li et al.

(10) Patent No.: US 7,442,093 B2
(45) Date of Patent: Oct. 28, 2008

(54) CARD EDGE CONNECTOR WITH DURABLE KEY

(75) Inventors: Hua Li, Kunshan (CN); Xiao-Gao Yang, Kunshan (CN); Zhen-Hua Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/009,485

(22) Filed: Jan. 18, 2008

(65) Prior Publication Data

US 2008/0176451 A1 Jul. 24, 2008

(51) Int. Cl.
*H01R 13/64* (2006.01)

(52) U.S. Cl. ..... 439/681; 439/633

(58) Field of Classification Search ..... 439/633, 439/681, 567

See application file for complete search history.

(56) References Cited

U.S. PATENT DOCUMENTS

| | | | | |
|---|---|---|---|---|
| 4,307,927 | A * | 12/1981 | Mollman | 439/681 |
| 6,165,025 | A * | 12/2000 | Meng | 439/681 |
| 6,174,184 | B1 * | 1/2001 | Meng | 439/188 |
| 6,540,539 | B2 | 4/2003 | Yahiro et al. | |
| 7,364,467 | B2 * | 4/2008 | Chen et al. | 439/633 |
| 2007/0173126 | A1 | 7/2007 | Chen et al. | |

* cited by examiner

*Primary Examiner*—Tho D Ta
(74) *Attorney, Agent, or Firm*—Wei Te Chung

(57) ABSTRACT

A card edge connector is adapted for connecting a card to a mother board, includes a housing made from insulating material. The housing includes a slot for receiving the card, a retaining hole communicating with the slot and a plurality of conductive contacts received in the housing. A metallic key is received in the retaining hole discretely and have a recess thereof. A retaining section includes a body portion received in the recess of the key and a leg to connect with the mother board.

14 Claims, 4 Drawing Sheets

CARD EDGE CONNECTOR WITH DURABLE KEY

BACKGROUND OF THE INVENTION

1. Field of the Invention

The present invention relates to a card edge connector, and more particularly to a card edge connector with at least one durable anti-mismating key.

2. Description of the Related Art

A card edge connector disclosed in U.S. Pat. No. 6,540,539 includes an insulating housing defining a slot for receiving a card, and a plurality of contacts received along two opposite inner walls of the slot. A metallic key is inserted into the slot transversely, which is used for aligning with a notch of the card to prevent mis-mating of the card. The metallic key has a good capacity of prevention from abrasion of breakage. The discretely key need a large interference surface with the housing so that it can be retained in the housing steadily. However, the housing, especially a slit housing maybe distort during heating because of the large interference surface.

Hence, an improved card edge connector is desired to overcome above problems.

BRIEF SUMMARY OF THE INVENTION

It is an object of the present invention to provide a card edge connector capable of preventing from transmutation.

It is another object of the present invention to provide a card edge connector with a durable key capable of preventing from falling out.

It is a third object of the present invention to provide a card edge connector, which is connecting to a PCB steadily.

In order to obtain the objective above, A card edge connector adapted for connecting a card to a mother board, comprises a housing made from insulating material. The housing comprises a slot for receiving the card, a retaining hole communicating with the slot and a plurality of conductive contacts received in the housing. A metallic key is received in the retaining hole discretely and have a recess thereof. A retaining section comprises a body portion received in the recess of the key and a leg to connect with the mother board.

Other objects, advantages and novel features of the invention will become more apparent from the following detailed description of the present embodiment when taken in conjunction with the accompanying drawings.

DETAILED DESCRIPTION OF THE INVENTION

Figure 1:
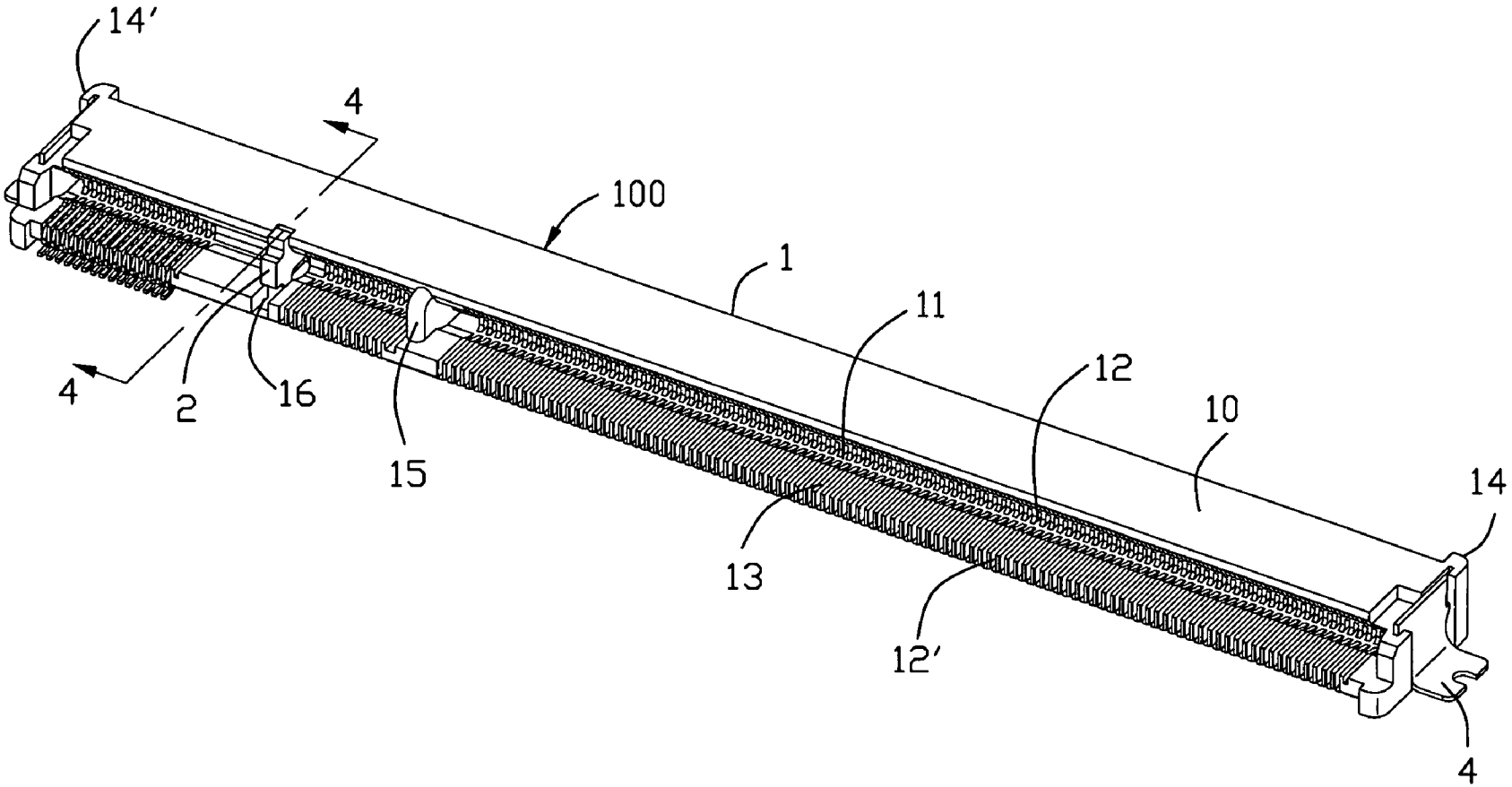
FIG. 1 is a front side perspective view of a card edge connector of the present invention.

Reference will now be made to the drawing figures to describe the present invention in detail.

Figure 2:
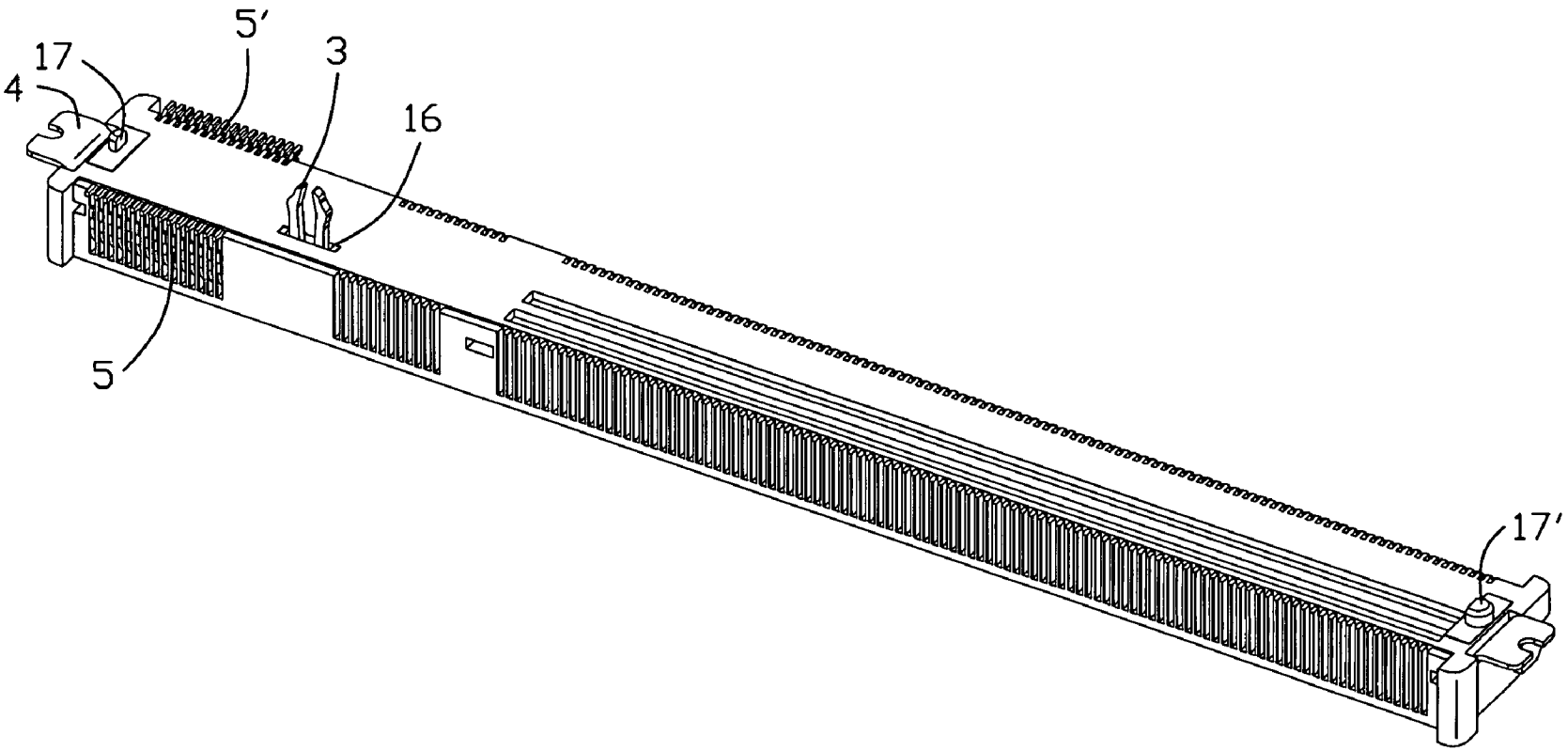
FIG. 2 is a bottom perspective view of the card edge connector of FIG. 1.
Figure 3:
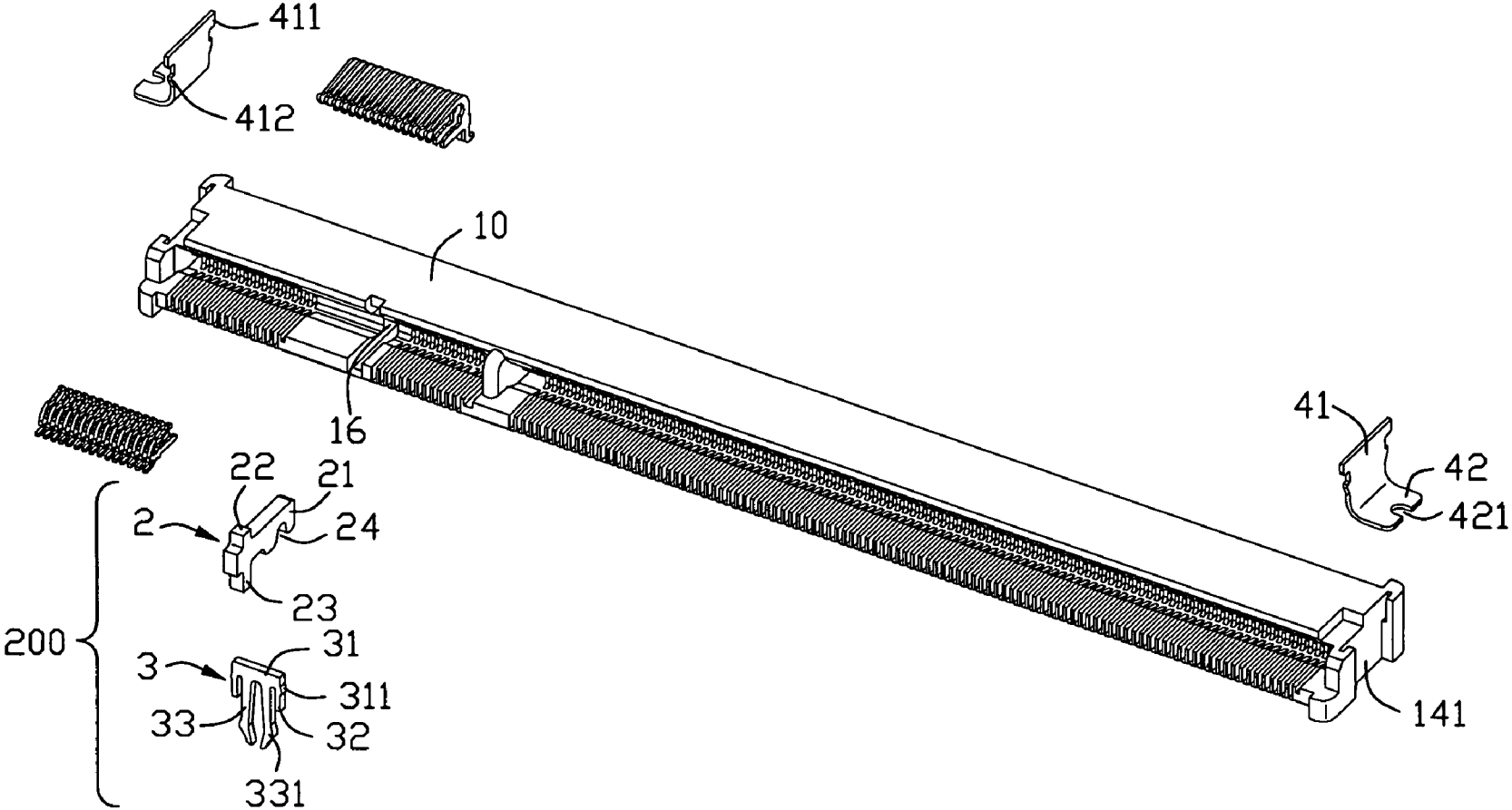
FIG. 3 is an exploded perspective view of the card edge connector of FIG. 1.

With reference to FIGS. 1 and 3, a card edge connector 100 in accordance to the present invention includes an insulating housing 1. The housing 1 includes an elongated base 10 defining a card-receiving slot 11 along a longitudinal direction thereof. Two rows of contact-receiving channels 12, 12' are defined along upper and lower inner walls of the card-receiving slot 11 to receive a plurality of conductive contacts 5, 5'. Each contact comprises a retaining section retained in the housing, a resilient contact section extending into the slot 11 and a leg, i.e. a soldering section extending out the bottom surface of the housing. The base 10 defines a right end 14 and a left end 14'. The ends have a retainer groove 141 respectively for receiving a metallic retaining member 4 therein. The retaining member 4 includes an vertical section 41 having an ear portion 411 and an agnail portion 412 respectively at the lateral side edges to retain the vertical section 41 in the groove 141, and an aclinic section 42 with a notch 421 for sucking otiose solder while the aclinic section is soldered to a mother board (not shown). The lower surface of the slot 11 form a platform 13 extending out beyond a tuber 15 for supporting a card (not shown). The housing 1 includes two positioning post 17, 17' (as shown in FIG. 2) at the bottom thereof, the two posts being of different configuration to prevent the connector 100 from being assembled to the mother board in a wrong direction. The tuber 15 locates in the slot 11 closer to the left end 14' of the base 10, and is integrally formed with the housing 1 for directing the card nicely aligning.

Figure 4:
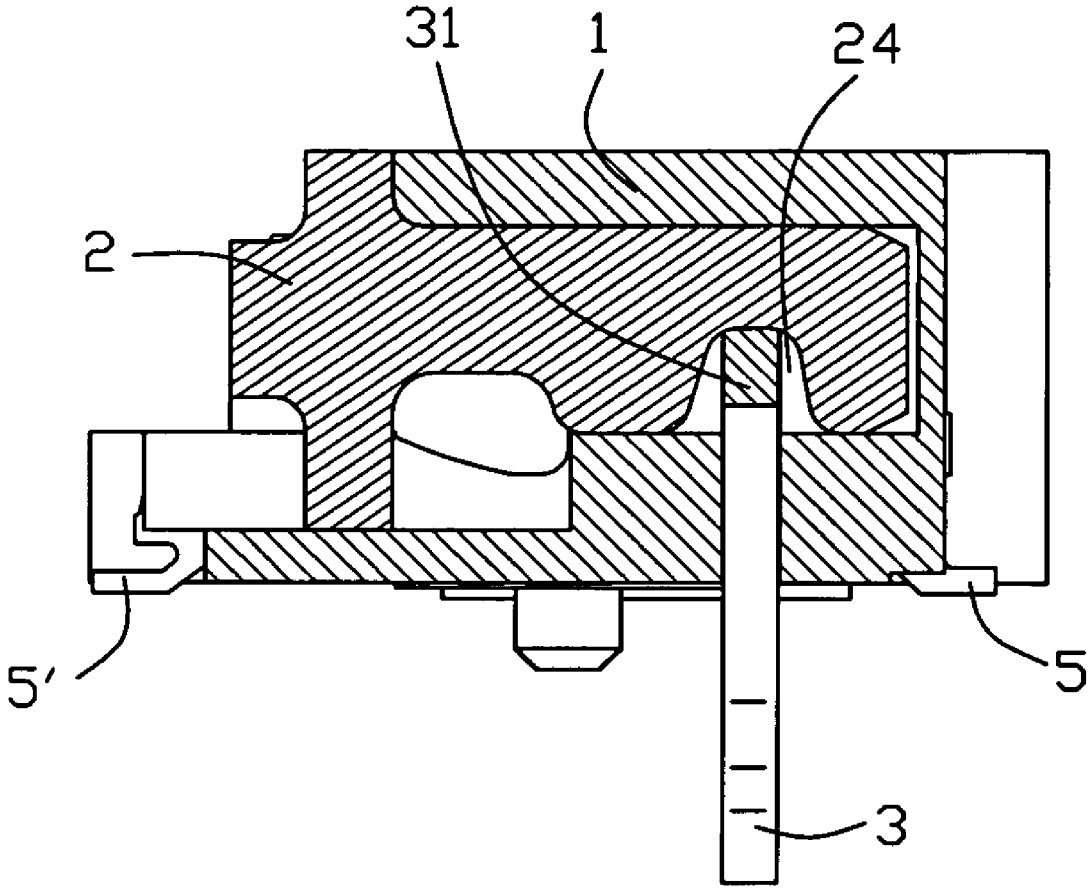
FIG. 4 is a cross-section view of the card edge connector in FIG. 1 taken along 4-4.

Referring to FIGS. 1 and 3, a retaining hole 16 is defined between the tuber 15 and the left end 14', which communicates with the slot 11 and throughout the base 10 transversely, clearly shown in FIG. 4. The card edge connector 100 further includes an assistant member 200, which is retained in retaining hole 16 of the housing 1. The assistant member 100 comprises a metallic key 2 and a metallic retaining section 3. The metallic key 2 is cross-shaped and includes an elongate base 21, flanges 22,23 on opposite upper and lower edges of the base and a recess 24 on a lower edge of the base 10. The recess 24 is defined with a semicircle shape and throughout the base 10 transversely. The retaining section 3 has a body portion 31, two linking arms 32 extending downwards from the bottom of body portion 31. Between the linking arms 32, two resilient legs 33 extending downwards from the body portion 31.

As shown in FIGS. 3 and 4, the metallic key 2 is inserted into the retaining hole 16 from the front open of the slot 11. Then the retaining section 3 is inserted into the retaining hole 16 from the bottom of the housing until the body portion 31 of the retaining section comes into the recess 24. Accordingly, the key and the retaining section decussate when assembled. The linking arms 32 with an agnail 331 interface with an innerside of the retaining hole 16 and retained the linking member 32 in the retaining hole 16. The body portion 31 stops the metallic key 2 slacking in the front and back direction. The resilient leg 33 is used for connecting with a through hole of the mother board.

The metallic key 2 and the tuber 15 of this invention in the slot 11 divide the slot 11 into three parts. The slot can receive different type of cards respectively. Alternatively, the connector has the metallic key only, not the tuber.

The retaining section of this invention can fitly retain the key in the house. Moreover, the retaining section 3 can provide another function, namely the resilient leg is used to connect the mother board.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A card edge connector adapted for connecting a card to a mother board, comprising:

a housing made from insulating material and comprising a slot for receiving the card, a retaining hole communicating with the slot;

a plurality of conductive contacts received in the housing;

a metallic key received in the retaining hole discretely, having a recess thereof; and a retaining section comprising a body portion received in the recess of the metallic key and a leg to connect with the mother board.

2. The card edge connector according to claim 1, wherein the retaining section is made from metal material.

3. The card edge connector according to claim 1, wherein the retaining section has two linking arms extending downwards from the body portion to interfere with the retaining hole.

4. The card edge connector according to claim 1, wherein the metallic key is cross-shaped and comprising an elongate base, flanges on opposite upper and lower edges of the base.

5. The card edge connector according to claim 1, wherein the housing further comprising a tuber integrally formed with the housing for directing a card nicely aligning.

6. The card edge connector according to claim 1, wherein the housing defines thereof two grooves at two opposite ends for receiving retaining members respectively.

7. The card edge connector according to claim 1, wherein the metallic key is inserted into the retaining hole from an open of the slot and the retaining section is inserted into the retaining hole from a bottom of the housing.

8. The card edge connector according to claim 7, wherein the metallic key and the retaining section decussate when assembled.

9. An electrical card edge connector for use with a card, comprising:

an insulative housing defining a central slot extending along a first direction; two rows of contacts respectively located by two sides of the central slot;

a key inserted into the insulative housing along a second direction, which is perpendicular to the first direction and along which the card is allowed to be moved relative to the insulative housing, said key having a portion interrupting the central slot for receiving a notch of the card; and a board lock assembled to the insulative housing along a third direction perpendicular to said first direction and said second direction; wherein said key and said board lock is interengaged with each other.

10. The card edge connector as claimed in claim 9, wherein said second direction is defined from a front portion to a rear portion of the insulative housing horizontally.

11. The card edge connector as claimed in claim 9, wherein said key is not exposed to an exterior around a rear portion of the insulative housing.

12. The card edge connector as claimed in claim 9, wherein said board lock locks the key to prevent withdrawal of the key opposite to said second direction.

13. The card edge connector as claimed in claim 12, wherein said board lock extends into the central slot to lock said key.

14. An electrical card edge connector for use with a card, comprising:

an insulative housing defining a central slot extending along a first direction; two rows of contacts respectively located by two sides of the central slot; a key inserted into the insulative housing along a second direction, which is perpendicular to the first direction and along which the card is allowed to be moved relative to the insulative housing, said key having a portion interrupting the central slot for receiving a notch of the card; and a board lock assembled to the insulative housing along a third direction perpendicular to said first direction and said second direction; wherein said key is required to be assembled to a final position before said board lock is assembled to a final position, thus assuring the key is locked in position in the insulative housing;

wherein said board lock is directly latchably engaged with the key.

* * * * *